US011496838B2

(12) United States Patent
Colich

(10) Patent No.: US 11,496,838 B2
(45) Date of Patent: Nov. 8, 2022

(54) ELECTROACOUSTIC TRANSDUCER ASSEMBLY

(71) Applicant: Audeze, LLC, Santa Ana, CA (US)

(72) Inventor: Dragoslav Colich, Orange, CA (US)

(73) Assignee: AUDEZE, LLC, Santa Ana, CA (US)

( * ) Notice: Subject to any disclaimer, the term of this patent is extended or adjusted under 35 U.S.C. 154(b) by 0 days.

(21) Appl. No.: 16/852,409

(22) Filed: Apr. 18, 2020

(65) Prior Publication Data

US 2021/0329382 A1 Oct. 21, 2021

(51) Int. Cl.

| | |
|---|---|
| ***H04R 1/08*** | (2006.01) |
| ***H04R 9/08*** | (2006.01) |
| ***H04R 11/04*** | (2006.01) |
| ***H04R 17/02*** | (2006.01) |
| ***H04R 19/02*** | (2006.01) |
| ***H04R 7/06*** | (2006.01) |

(52) U.S. Cl.
CPC ..... *H04R 7/06* (2013.01)

(58) Field of Classification Search
CPC . H04R 1/08; H04R 9/08; H04R 11/04; H04R 17/02; H04R 19/04; H04R 21/02; H04R 19/00; H04R 19/01; H04R 19/013
USPC ..... 381/170–171, 173–174, 176, 191
See application file for complete search history.

(56) References Cited

U.S. PATENT DOCUMENTS

| | | | | |
|---|---|---|---|---|
| 3,894,333 | A * | 7/1975 | Chang | H04R 19/013 29/594 |
| 4,207,442 | A * | 6/1980 | Freeman | H04R 3/00 381/116 |
| 6,393,129 | B1 * | 5/2002 | Conrad | H04R 19/00 381/191 |
| 6,434,245 | B1 * | 8/2002 | Zimmermann | H04R 19/02 381/191 |
| 6,584,206 | B2 * | 6/2003 | Ohashi | H04R 19/02 381/174 |
| 8,175,294 | B2 * | 5/2012 | Jansen | H04R 19/02 381/116 |
| 8,737,663 | B2 * | 5/2014 | Jilani | H04R 17/02 381/174 |
| 2006/0147081 | A1 * | 7/2006 | Mango, III | H04R 31/003 381/398 |
| 2006/0188708 | A1 | 8/2006 | Hideaki Nitta | |
| 2012/0051564 | A1 * | 3/2012 | Liou | H04R 19/02 381/191 |
| 2013/0301856 | A1 * | 11/2013 | Kim | H04R 7/26 381/190 |

FOREIGN PATENT DOCUMENTS

JP 2003319488 A 11/2003

* cited by examiner

*Primary Examiner* — Suhan Ni
(74) *Attorney, Agent, or Firm* — Wayne R. Howe

(57) ABSTRACT

An electroacoustic transducer assembly includes an electrostatic diaphragm having a surface. The diaphragm includes a film of flexible insulating material and electrically conductive material within the film to achieve a uniform electrical resistivity over the surface.

20 Claims, 12 Drawing Sheets

ELECTROACOUSTIC TRANSDUCER ASSEMBLY

BACKGROUND

An electroacoustic transducer assembly may include a planar electrostatic diaphragm between two stator plates. The planar diaphragm includes a non-conductive film and conductive layers coated on one or both opposite surfaces of the film. When a DC (Direct Current) bias voltage is applied to the diaphragm, and a varying AC (Alternating Current) signal is applied to the stator plates, the diaphragm interacts with the AC signal on the stator plates to push and pull the diaphragm to reproduce a desired sound.

Repeated push and pull or other degradation such as chemical interactions with the air can eventually cause the conductive layers to deteriorate. Sound degradation can eventually occur.

DETAILED DESCRIPTION

Figure 1:
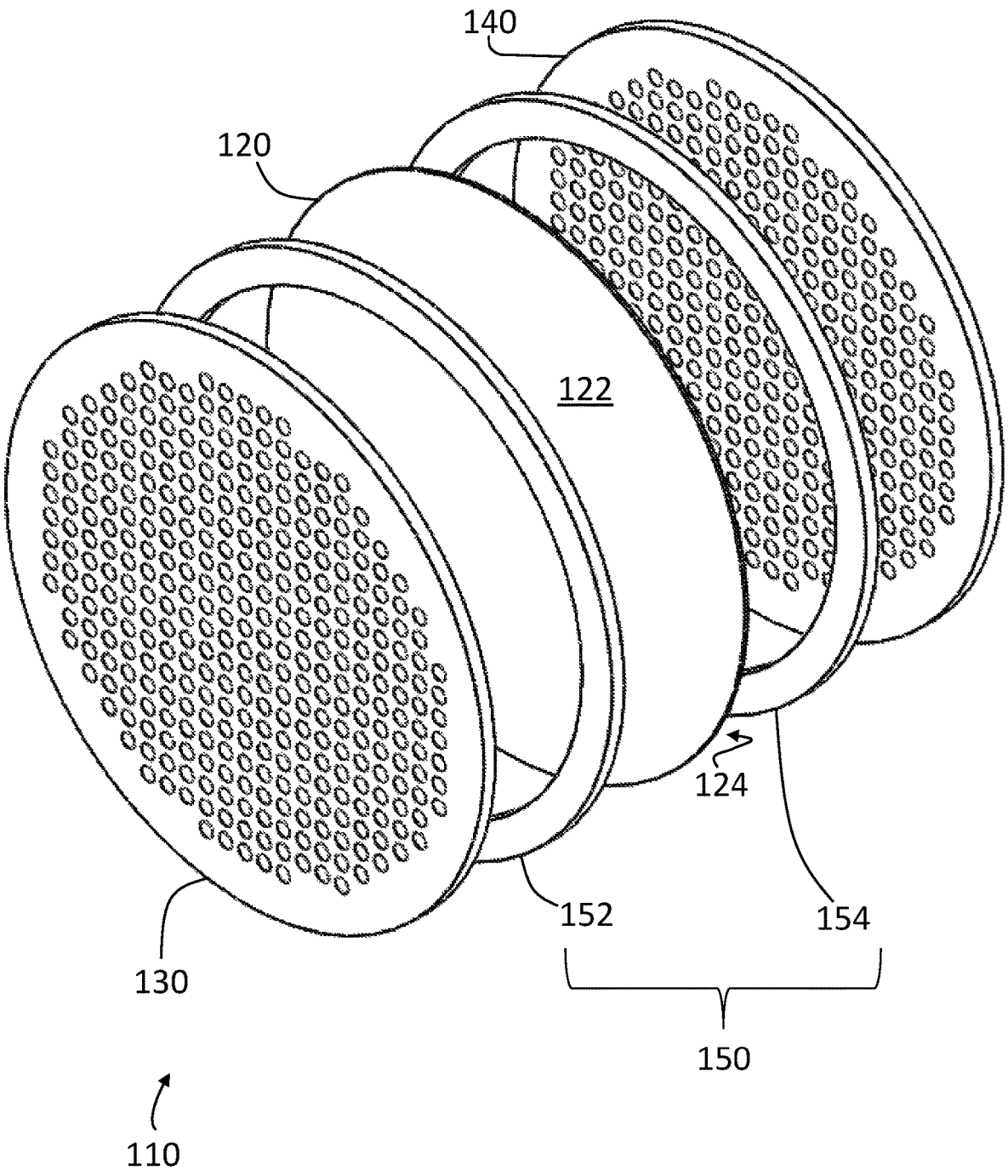
FIG. 1 is an exploded view of an electrostatic diaphragm, located between front and rear stators, and front and rear frame pieces of an electroacoustic transducer assembly.
Figure 2:
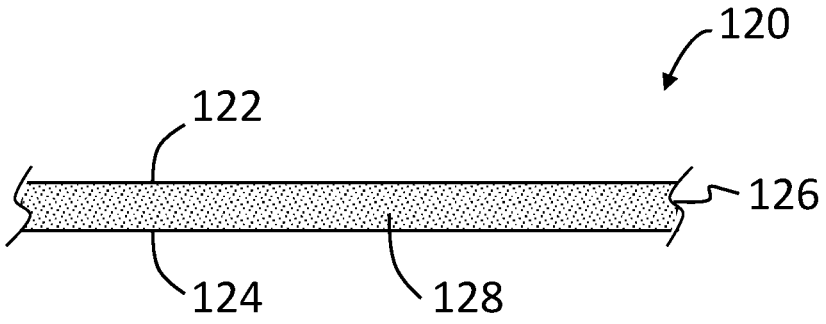
FIG. 2 is an illustration of a cross-section of an electrostatic diaphragm of the electroacoustic transducer assembly.

Referring to FIGS. 1 and 2, an electrostatic transducer assembly 110 includes an electrostatic diaphragm 120 having a front surface 122 and a rear surface 124. The diaphragm 120 includes a film 126 of flexible insulating material and electrically conductive material 128 within the film 126 to achieve a uniform electrical surface resistivity over the front and rear surfaces 122 and 124. Examples of the electrically conductive material 128 include, but are not limited to carbon nanotubes, graphene, graphite, and particles of metals such as gold, silver and copper. Examples of the insulating material include, but are not limited to polyimide (e.g., Kapton), polyester, and polyamide (e.g., nylon), polypropylene, polyurethane, and/or other types of plastic. The diaphragm 120 may have a circular shape, a rectangular shape, or any other shape.

The electrically conductive material 128 is preferably within an entire volume of the film 126 to achieve an even distribution of surface resistivity. This even distribution can produce a more uniform transfer of forces. If the distribution is not even, then the diaphragm 120 may be pushed and pulled differently at discrete points rather than uniformly across its surfaces 122 and 124.

The transducer assembly 110 further includes at least one "acoustically transmissive" stator. As used herein, an acoustically transmissive stator refers to a stator that is not of solid construction, but rather allows air to pass through so sound can be transmitted for sound reproduction. An acoustically transmissive stator comprises aspects that are electrically conductive. Examples of acoustically transmissive stators include, but are not limited to, stators made of metal wires, perforated metal plate, and parallel wires that are spaced apart. Stators may be constructed of many materials such as PCBs (printed circuit board) and other rigid or semi-rigid materials.

FIG. 1 shows the transducer assembly 110 with a front stator 130 opposite the front surface 122 of the diaphragm 120, and a rear stator 140 opposite the rear surface 124 of the diaphragm 120. Both stators 130 and 140 are structurally rigid or semi-rigid. The front stator 130 is an acoustically transmissive stator. Although FIG. 1 shows the rear stator 140 as an acoustically transmissive stator, it may instead be of solid construction, whereby air would only pass through the front stator 130.

A frame 150 holds the diaphragm 120 between the front and rear stators 130 and 140. FIG. 1 shows the frame 150 as having a two-piece construction, with the diaphragm 120 between front and rear frame pieces 152 and 154 for spacing between the diaphragm 120 and front and rear stators 130 and 140.

Figure 3:
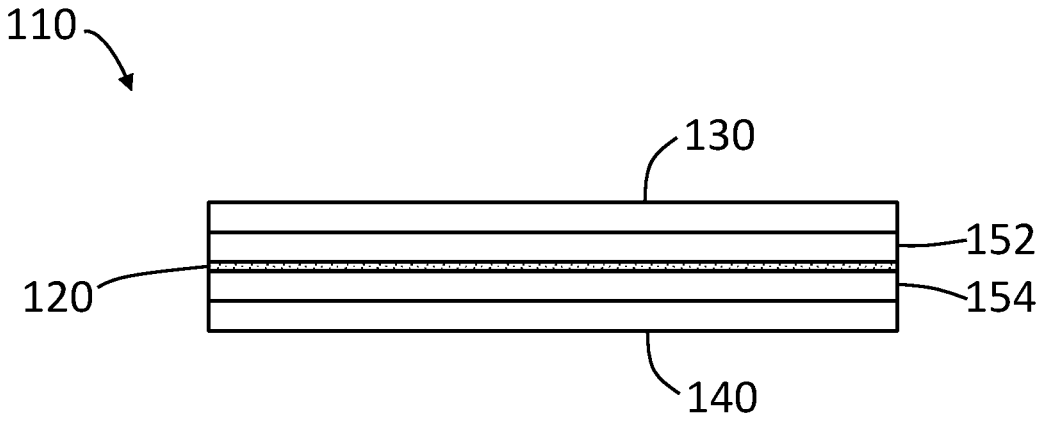
FIG. 3 is an illustration of a cross-section of the electroacoustic transducer assembly with those parts assembled.

Additional reference is made to FIG. 3, which illustrates the diaphragm 120 secured between the front and rear frame pieces 152 and 154 of the frame, the front stator 130 secured to the front frame piece 152, and the rear stator 140 secured to the rear frame piece 154. Adhesive and/or other attaching or affixing means may be used to secure the diaphragm 120 and the stators 130 and 140 to the frame pieces 152 and 154. Front and/or rear frame pieces 152 and/or 154 may be made of various materials, for example non-conductive materials such as various plastics or FR4 as is known in the art, or conductive materials such as FR4 with conductive surfaces, stainless steel, or various metals, or other hybrid materials.

The diaphragm 120 may be planar at rest. That is, the diaphragm 120 may be planar when the driving signals and bias voltage are not being applied.

Thickness of the front frame piece 152 determines a gap size (that is, distance) between the front stator 130 and the diaphragm 120 at rest. Similarly, thickness of the rear frame piece 154 determines the gap size between the rear stator 140 and the diaphragm 120 at rest.

Resistivity of the diaphragm 120 and the stators 130 and 140 is a function of whether a driving signal is applied to the diaphragm 120 or the stators 130 and 140. Consider a first configuration of the transducer assembly 110, where the bias voltage is applied to the diaphragm 120 and the driving signal is applied to the stators 130 and 140. In this first configuration, surface resistivity of the diaphragm 120 is in a range from about 1 kilo ohms/square to about 10 giga ohms/square, and preferably in a narrower range of from about 100 mega ohms/square to about 1 giga ohms/square. Resistivity of the stators 130 and 140 is in the range of about 0.05 milli ohms/square to about 10 kilo ohms/square. Stators may have a nonconductive coating to prevent arcing.

Figure 4:
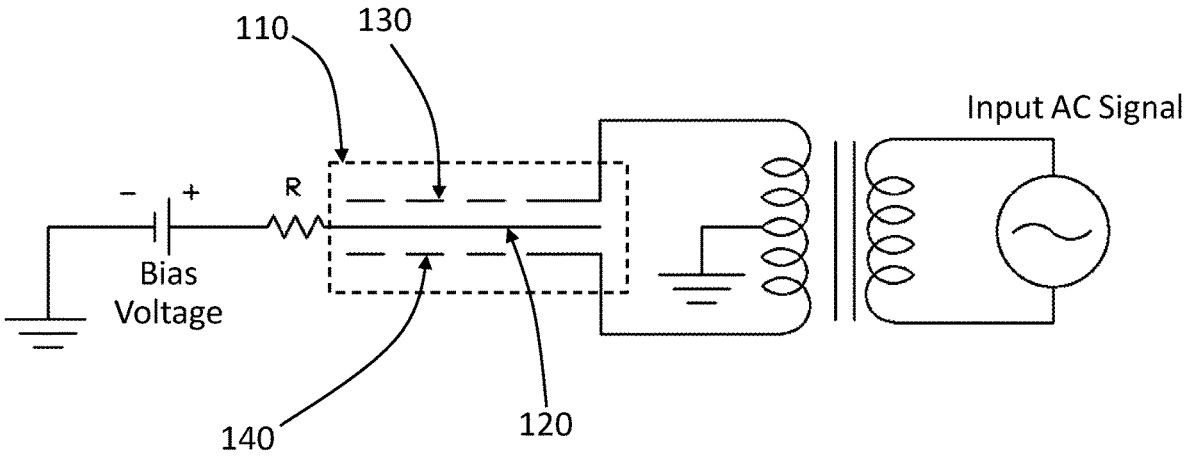
FIG. 4 is an illustration of a circuit for and a method for applying and operating driving input signals and a bias voltage to a first configuration of the electroacoustic transducer assembly.

FIG. 4 illustrates an example of a circuit for applying the driving signals and bias voltage to the first configuration of the transducer assembly 110 shown in the dashed box. A bias voltage (DC) is applied to the diaphragm 120 through a resistor R. Current flows into the diaphragm 120 until a full electrostatic charge is built up. When a driving signal (AC) is applied to the stators 130 and 140, the electrostatic charge on the diaphragm 120 interacts with a varying electrostatic field on the stators 130 and 140 to push and pull the diaphragm 120, interacting to reproduce a desired sound. The bias voltage (DC) may vary depending upon the application, the size of the diaphragms, the size of the gap, etc. For example, large over-the-ear electrostatic headphones may have bias voltages of 580 Volts, large speakers may have several thousand volts, while small in-ear electrostatic transducers may have bias voltages as low as 50 volts or less. Driving signal (AC) maximum voltages may also vary depending upon the application, the size of the diaphragm, the size of the gap between the diaphragm and stators, the acoustic power desired, etc. Maximum driving voltages are generally in the same ranges as bias voltages. Metal electrodes or conductive adhesive may be used to connect and apply the voltages to the diaphragm 120 to charge it.

Now consider a second configuration of the transducer assembly 110, where the bias DC voltages are applied to the stators 130 and 140 and the driving AC signal is applied to the diaphragm. In this second configuration, surface resistivity of the diaphragm 120 may be lower, in a range from about 1 milli ohm/square to about 10 kilo ohms/square; and resistivity of the stator is in a range from about 1 kilo ohms/square to about one giga ohms/square. To obtain a resistivity within this range, the stators 130 and 140 may be comprised of a conductive material or coated with a conductive layer. A dielectric coating may be applied on the stators adjacent the diaphragm to prevent arcing.

Figure 5:
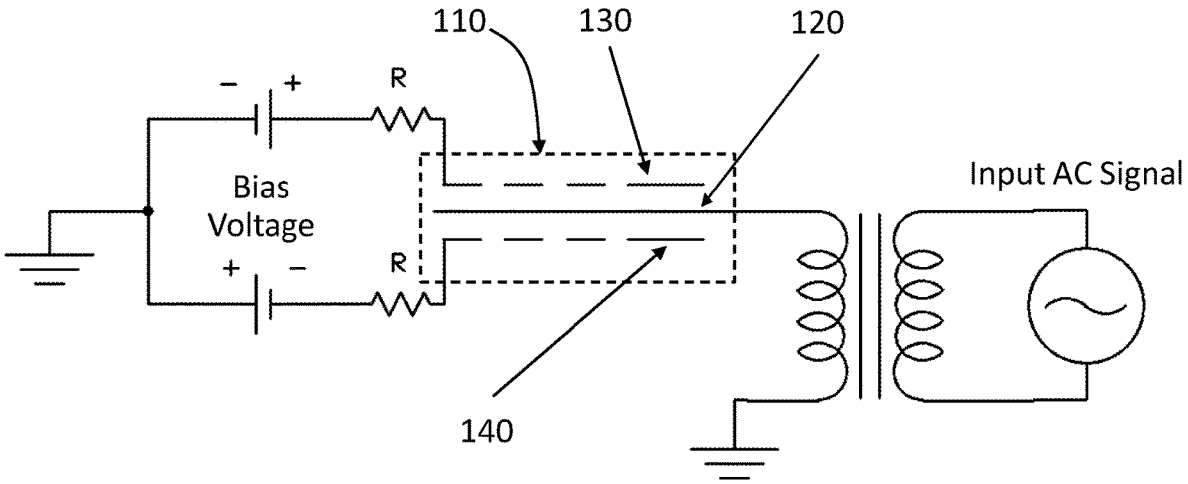
FIG. 5 is an illustration of a circuit and a method for applying and operating driving input signals and bias voltages to a second configuration of the electroacoustic transducer assembly.

FIG. 5 illustrates an example of a circuit for applying the bias voltages and driving signals to the second configuration of the electrostatic transducer assembly 110 shown in the dashed box. A bias voltage (DC) is applied to the stators 130 and 140 through resistors R, and a driving signal (AC) is applied to the diaphragm 120. Electrostatic charge on the stators 130 and 140 interacts with a varying electrostatic field on the diaphragm 120 to push and pull the diaphragm 120 to reproduce a desired sound. The bias voltages (DC) may vary depending upon the application, the size of the diaphragms, the size of the gap, etc. For example, large over-the-ear electrostatic headphones may have bias voltages of around 580 Volts, large speakers may have several thousand volts, while small in-ear electrostatic transducers may have bias voltages as low as 50 volts or less. Driving signal (AC) maximum voltages may also vary depending upon the application, the size of the diaphragm, the size of the gap, the acoustic power desired, etc. Maximum driving voltages are generally in the same ranges as bias voltages.

Diaphragms may be tensioned. Actual values for tensions of the diaphragm 120 are application specific. Factors include size and shape of the transducer assembly 110, and desired frequency response or target resonance of one or more resonant peaks.

Thickness of the diaphragm 120 may be between about 0.05 microns and 200 microns. The actual thickness may depend on several factors, such as the desired frequency response, and maximum deflection of the diaphragm. A thicker diaphragm may allow higher tension and better control and less chance of arcing and/or sticking to the stator. Higher voltages enable higher forces to be applied and greater deflection of the diaphragm to result.

An electroacoustic transducer assembly herein is not limited to the two stator plates and a single diaphragm. For instance, FIG. 6 illustrates an electroacoustic transducer assembly 610 including an electrostatic diaphragm 120, a single stator 130 that is acoustically transmissive, and front and rear frame pieces 152 and 154.

Figure 6:
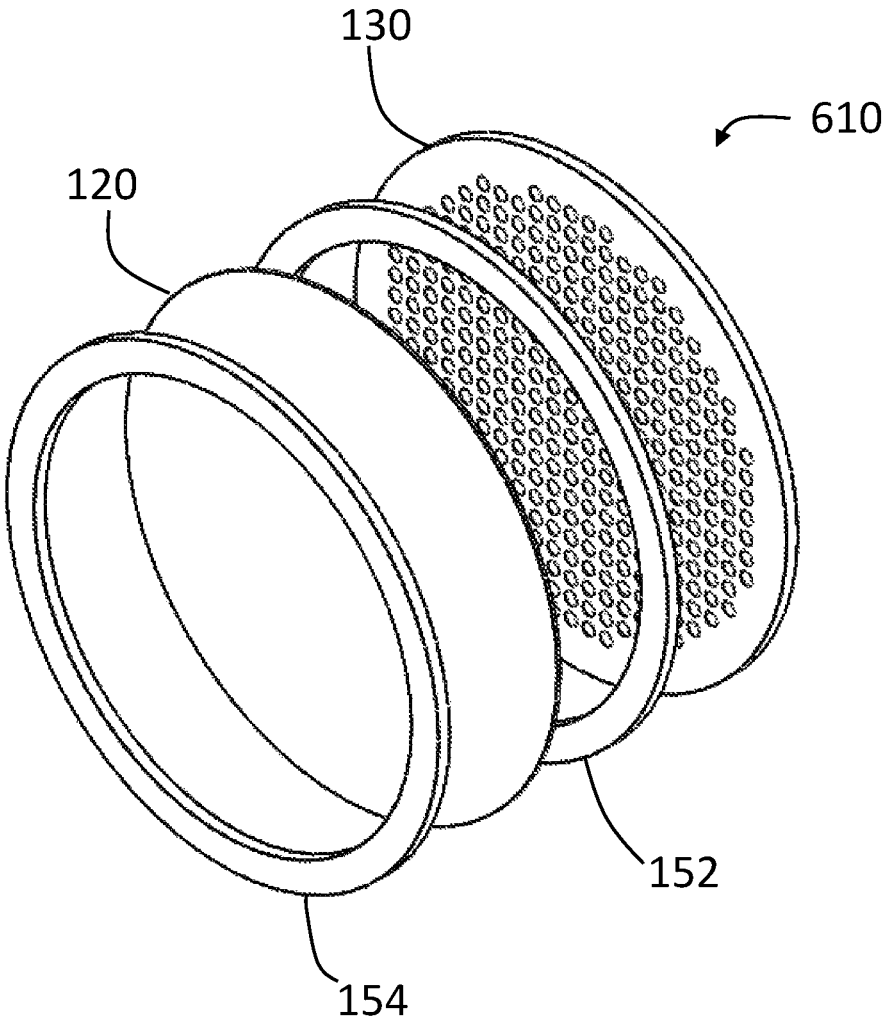
FIG. 6 is an exploded view of an electrostatic diaphragm located opposed a single front stator, and front and rear frame pieces of an electroacoustic transducer assembly.
Figure 7:
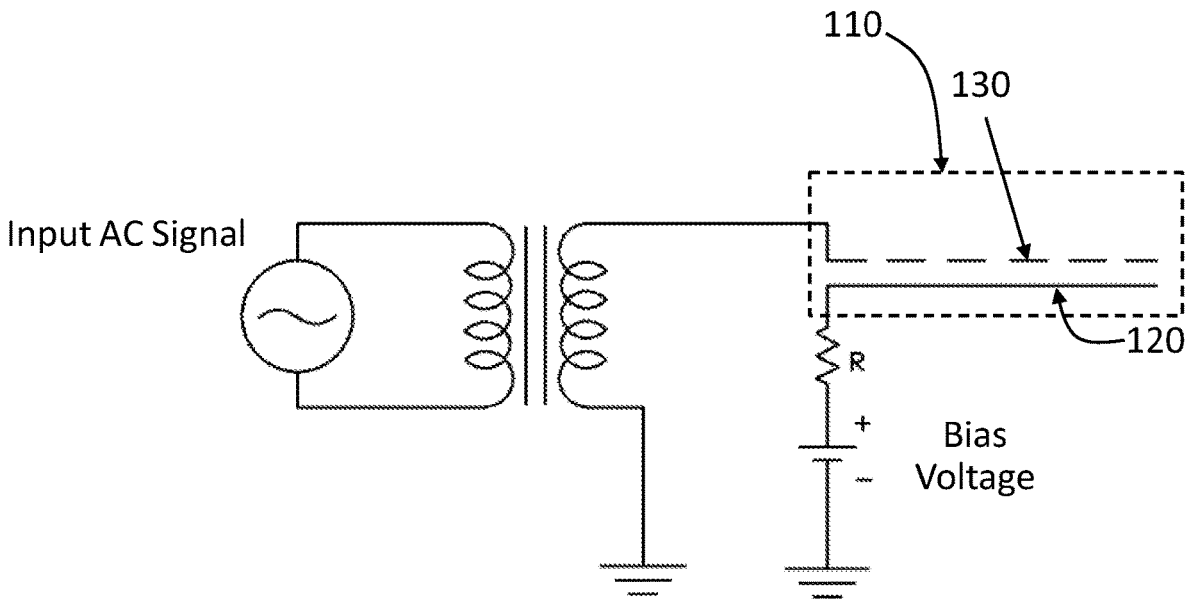
FIG. 7 is an illustration of a circuit for applying driving signals and a bias voltage to an electroacoustic transducer assembly having an electrostatic diaphragm and a single stator. Conversely, the opposite configuration of bias voltage and AC signal may be used.

FIG. 7 illustrates an example of a circuit for applying the driving signal (AC) and bias voltage (DC) to the transducer assembly 610 of FIG. 6. The bias voltage (DC) is applied to the diaphragm 120, and the driving signal (AC) is applied to the stator 130. Electrostatic charge on the diaphragm 120 interacts with a varying electrostatic field on the stator 130 to push and pull the diaphragm 120 to reproduce a desired sound. The bias DC voltage(s) and AC signal are in similar ranges as discussed previously.

Figure 8:
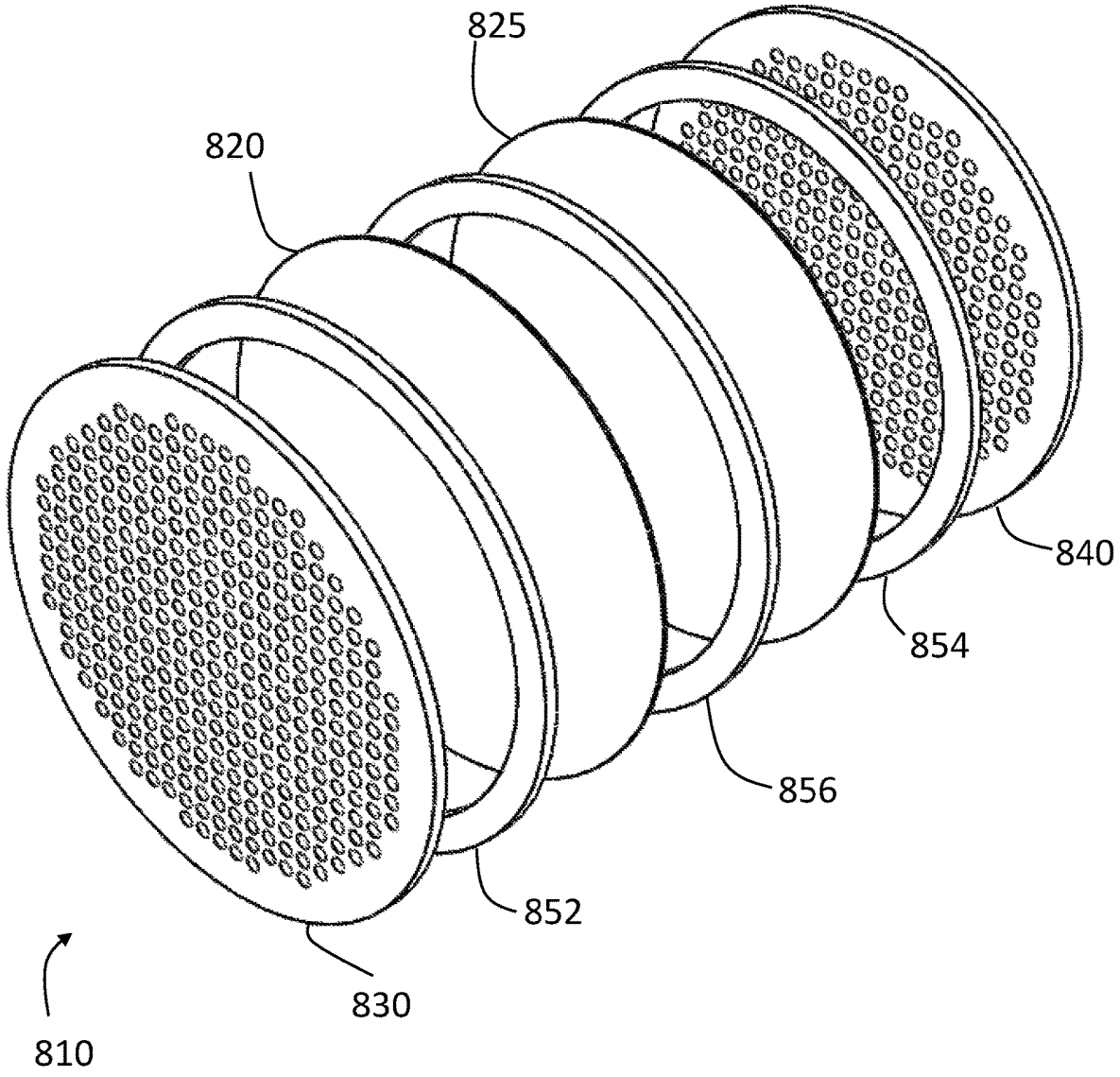
FIGS. 8-11 are illustrations of electroacoustic transducer assemblies.

An electroacoustic transducer assembly herein is not limited to a single electrostatic diaphragm. FIGS. 8 to 11 illustrate electroacoustic transducer assemblies 810, 910, 1010 and 1110 with multiple electrostatic diaphragms FIG. 8 shows an electroacoustic transducer assembly 810 including front and rear stators 830 and 840, and front and rear electrostatic diaphragms 820 and 825. Two or more diaphragms may be used adjacent to each other. In this configuration, the multiple diaphragms may act as a single diaphragm with spaces between the diaphragms in a way that air trapped between the diaphragms will increase the total air pressure moved. In this way, the total transducer may become more efficient with multiple diaphragms multiplying the force. A front frame piece 852 sets the gap size between the front stator 830 and the front electrostatic diaphragm 820. A rear frame piece 854 sets the gap size between the rear stator 840 and the rear electrostatic diaphragm 825. A middle frame piece 856 sets the gap size between the front and rear diaphragms 820 and 825.

Figure 9:
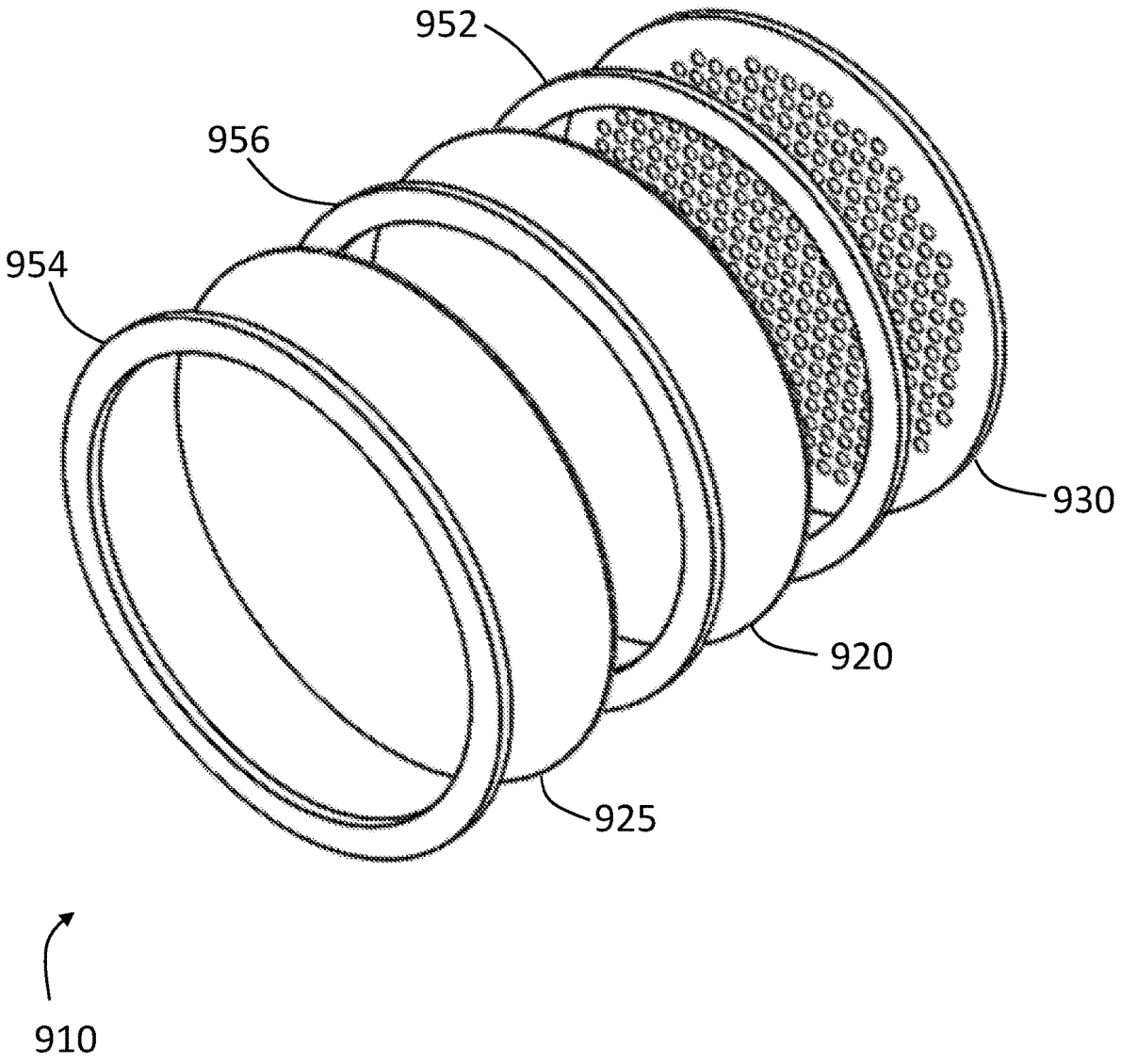

FIG. 9 shows an electroacoustic transducer assembly 910 including a front stator 930 and front and rear electrostatic diaphragms 920 and 925. A front frame piece 952 sets the gap size between the front stator 930 and the front electrostatic diaphragm 920. The front electrostatic diaphragm 920 is supported between the front frame piece 952 and a middle frame piece 956. The rear electrostatic diaphragm 925 is supported between the middle frame piece 956 and a rear frame piece 954. Two or more diaphragms may be used adjacent to each other in this type of configuration.

Figure 10:
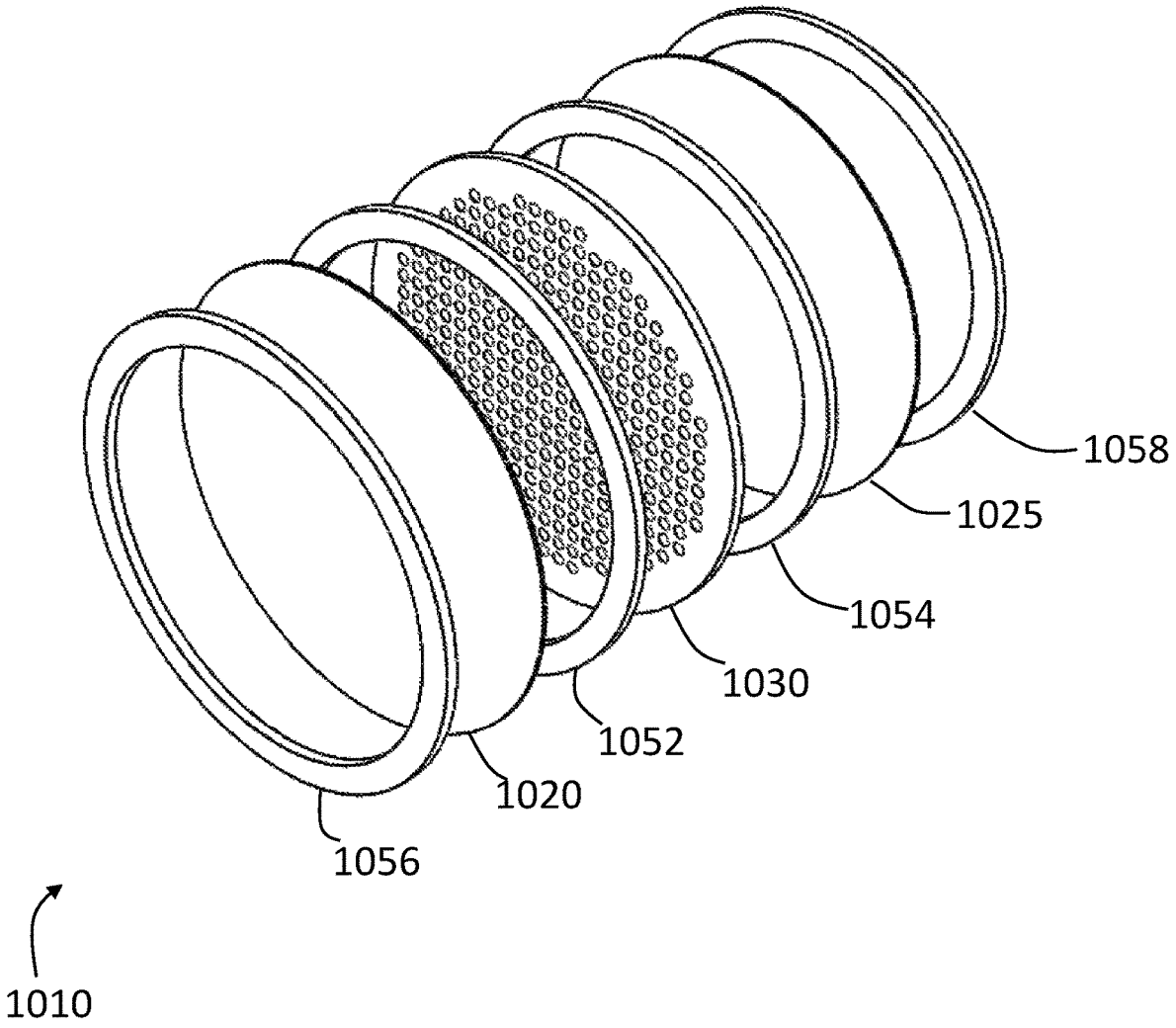

FIG. 10 shows an electroacoustic transducer assembly 1010 including a single stator 1030 and front and rear electrostatic diaphragms 1020 and 1025. The stator 1030 is between and common to both electrostatic diaphragms 1020 and 1025. Frame pieces 1052, 1054, 1056 AND 1058 support the electrostatic diaphragms 1020 and 1025 and frame pieces 1052 and 1054 set the gap sizes with the stator 1030. In this push-pull configuration, the total transducer may become more efficient with dual diaphragms multiplying the force.

Figure 11:
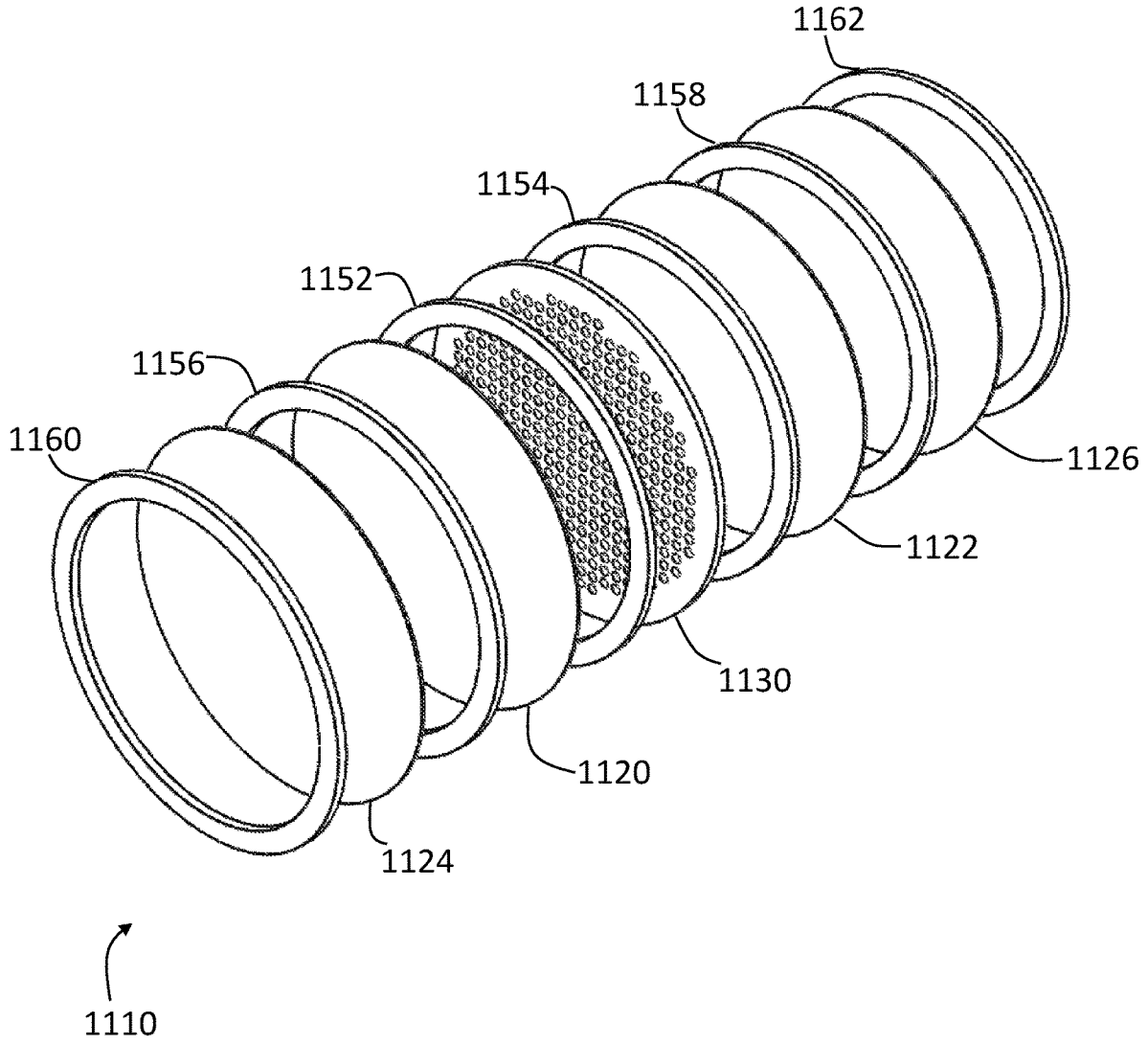

FIG. 11 shows an electroacoustic transducer assembly 1110 including a single stator 1130 between first and second electrostatic diaphragms 1120 and 1122. Two or more adjacent diaphragms may be used. For example, the electroacoustic transducer assembly 1110 further includes a third electrostatic diaphragm 1124 opposite the first diaphragm 1120, and fourth electrostatic diaphragm 1126 opposite the second diaphragm 1122. Frame pieces 1152, 1154, 1156, 1158, 1160, and 1162 support the diaphragms 1120, 1122, 1124, and 1126, and frame pieces 1152, 1154, 1156, and 1158 set the gap sizes.

An electroacoustic transducer assembly herein is not limited to a stator that is planar. For example, a non-planar stator may be shaped (e.g., curved, indented) to match the surface of the diaphragm when the diaphragm is in a fully deflected position.

An electroacoustic transducer assembly herein may be used in an audio device that reproduces sound. Reproducing sound and sound reproduction as used herein does not only refer to the use of electrical signals to create sound. It also refers to the use of sound waves to create electric signals. For instance, a transducer assembly herein may be operated as a microphone by applying a DC voltage to one of the diaphragm and the stator, and outputting an AC signal that is induced in the other of the diaphragm and the stator.

Figure 12A:
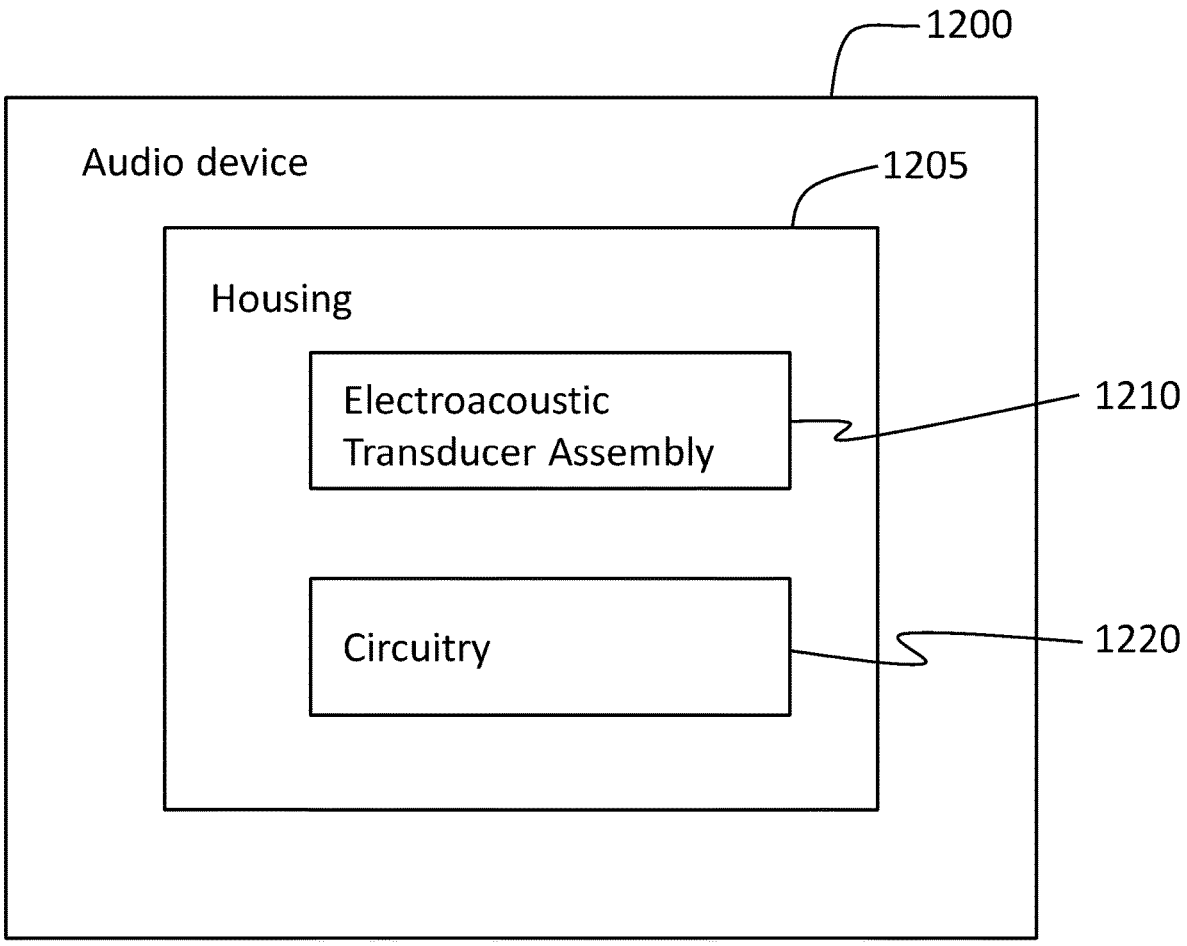
FIGS. 12A and 12B are illustrations of audio devices including an electroacoustic transducer assembly.

Reference to FIG. 12A, which illustrates an audio device 1200 including a housing 1205, an electroacoustic transducer assembly 1210 mounted within the housing 1205, and circuitry 1220 for applying a bias voltage and a driving signal to the transducer assembly 1210. The audio device 1200 may be configured as a loudspeaker, and/or headphones including but not limited to over-the-ear, on-ear, and in-ear audio device, and/or microphone.

The audio device 1200 is adapted to receive an AC signal from an external source. The audio device 1200 is also adapted to receive DC power for the bias voltage.

Figure 12B:
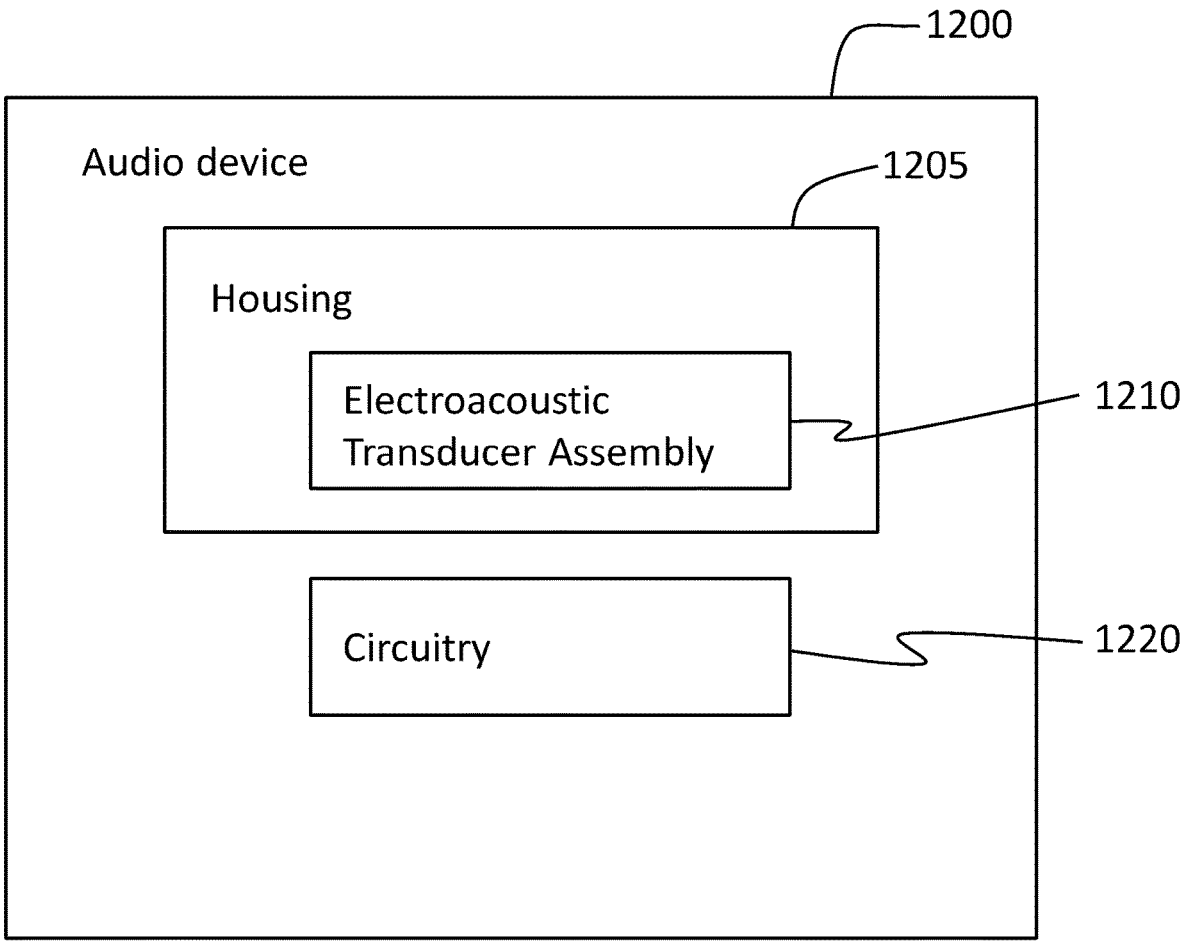

Alternatively, reference to FIG. 12B, which illustrates an audio device 1200 including a housing 1205, an electroacoustic transducer assembly 1210 mounted within the housing 1205, and circuitry 1220 for applying a bias voltage and a driving signal to the transducer assembly 1210. In this embodiment, circuitry 1220 is external to the housing 1205. The audio device 1200 may be configured as a loudspeaker, and/or headphones including but not limited to over-the-ear, on-ear, and in-ear audio device, and/or microphone.

The invention claimed is:

1. An electroacoustic transducer assembly comprising:

a first electrostatic diaphragm having a surface, the first electrostatic diaphragm including a film of flexible insulating plastic material having electrically conductive material distributed within an entire volume of the film to achieve a uniform electrical resistivity over the surface.

2. The electroacoustic transducer assembly of claim 1, wherein the first electrostatic diaphragm is planar at rest.

3. The electroacoustic transducer assembly of claim 1, wherein the electrically conductive material is evenly distributed within the_entire volume of the film to achieve an even distribution of surface resistivity.

4. The electroacoustic transducer assembly of claim 1, wherein thickness of the first electrostatic diaphragm is between about 0.05 and 200 microns.

5. The electroacoustic transducer assembly of claim 1, further comprising a first stator opposite the surface of the first electrostatic diaphragm.

6. The electroacoustic transducer assembly of claim 5, wherein the first stator is structurally rigid and acoustically transmissive.

7. The electroacoustic transducer assembly of claim 5, wherein the uniform electrical resistivity over the surface of the first electrostatic diaphragm is in a range from about 1 kilo ohm/square to about 10 giga ohm/square.

8. The electroacoustic transducer assembly of claim 5, wherein the uniform electrical resistivity over the surface of the first electrostatic diaphragm is in a range from about 100 mega ohms/square to about 1 giga ohm/square.

9. A method of operating the electroacoustic transducer assembly of claim 8, comprising applying a bias voltage to the first electrostatic diaphragm and a driving signal to the first stator to cause the first electrostatic diaphragm to reproduce a desired sound.

10. The electroacoustic transducer assembly of claim 5, wherein the uniform electrical resistivity over the surface of the first electrostatic diaphragm is in a range from about 1 milli ohms/square to about 10 kilo ohms/square; and wherein the first stator has a resistivity in a range from about 1 kilo ohm/square to about one giga ohm/square.

11. A method of operating the electroacoustic transducer assembly of claim 10, comprising applying a bias voltage to the first stator and a driving signal to the first electrostatic diaphragm to cause the first electrostatic diaphragm to reproduce a desired sound.

12. The electroacoustic transducer assembly of claim 5, further comprising a frame for supporting the first electrostatic diaphragm and spacing the first electrostatic diaphragm apart from the first stator, wherein the first electrostatic diaphragm is tensioned.

13. The electroacoustic transducer assembly of claim 5, further comprising a second stator, wherein the first electrostatic diaphragm is located between the stators.

14. The electroacoustic transducer assembly of claim 5, further comprising a second electrostatic diaphragm opposite the first electrostatic diaphragm.

15. The electroacoustic transducer assembly of claim 5, further comprising a second electrostatic diaphragm, wherein the first stator is between and common to both electrostatic diaphragms.

16. A method of operating the electroacoustic transducer assembly of claim 5 as a microphone, comprising applying a dc voltage to one of the first electrostatic diaphragm and the first stator, and outputting an ac signal that is induced in the other of the first electrostatic diaphragm and the first stator.

17. The electroacoustic transducer assembly of claim 1, wherein the plastic material comprises at least one of polyimide, polyester, polyamide, polypropylene, or polyurethane.

18. An electroacoustic transducer assembly for sound reproduction, the assembly comprising:

a stator; and an electrostatic diaphragm for interacting with the stator to produce sound waves when an ac signal is applied to one of the electrostatic diaphragm and the stator and a dc voltage is applied to the other of the electrostatic diaphragm and the stator, the diaphragm including a film of flexible insulating plastic material having_electrically conductive material distributed within an entire volume of the film to achieve a uniform electrical resistivity over a surface of the diaphragm.

19. An audio device comprising a housing and a transducer assembly within the housing, the transducer assembly including:

a stator;

a frame; and an electrostatic diaphragm supported by the frame and located opposite the stator, the diaphragm including a film of flexible plastic insulating material having electrically conductive material distributed within the entire volume of the film to achieve a uniform electrical surface resistivity, the diaphragm tensioned to a target resonance.

20. The audio device of claim 19, further comprising circuitry for applying a bias voltage and a driving signal to the transducer assembly.

* * * * *